US011130045B2

(12) United States Patent
Pascal et al.

(10) Patent No.: US 11,130,045 B2
(45) Date of Patent: Sep. 28, 2021

(54) FASTENING DEVICE FOR FASTENING A BOOT TO A SLIDING BOARD

(71) Applicant: SKIS ROSSIGNOL, Saint-Jean-de-Moirans (FR)

(72) Inventors: Jean-Marc Pascal, Voreppe (FR); Adrien Reguis, Grenoble (FR); Vincent Gelin, Grenoble (FR); Arnaud Repa, Le Fontanil Cornillon (FR); Adrien Orsicelli, Grenoble (FR)

(73) Assignee: SKIS ROSSIGNOL, Saint-Jean-de-Moirans (FR)

( * ) Notice: Subject to any disclaimer, the term of this patent is extended or adjusted under 35 U.S.C. 154(b) by 0 days.

(21) Appl. No.: 16/882,230

(22) Filed: May 22, 2020

(65) Prior Publication Data

US 2020/0368603 A1 Nov. 26, 2020

(30) Foreign Application Priority Data

May 24, 2019 (FR) ..... 1905496
Aug. 2, 2019 (FR) ..... 1908869

(51) Int. Cl.
*A63C 10/04* (2012.01)
*A43B 5/04* (2006.01)

(52) U.S. Cl.
CPC ..... *A63C 10/04* (2013.01); *A43B 5/0401* (2013.01)

(58) Field of Classification Search
CPC ..... A63C 10/04; A63C 10/103
See application file for complete search history.

(56) References Cited

U.S. PATENT DOCUMENTS 4,177,584 A * 12/1979 Beyl ..... A43B 5/0417 280/613
5,520,406 A * 5/1996 Anderson ..... A63C 10/10 280/14.24
5,577,757 A * 11/1996 Riepl ..... A63C 10/08 280/617
6,050,590 A * 4/2000 Domon ..... A63C 10/10 280/630

(Continued)

FOREIGN PATENT DOCUMENTS

EP 0885036 B2 9/2007
WO 9847582 A1 10/1998

(Continued)

OTHER PUBLICATIONS

French Search Report and Written Opinion dated Mar. 23, 2020 in counterpart application No. FR 1908869; w/English machine translation (total 14 pages).

*Primary Examiner* — Brian L Swenson
(74) *Attorney, Agent, or Firm* — Seckel IP, PLLC

(57) ABSTRACT

The fastening device (3) for fastening a boot (4) to a sliding board (2) includes a base (10) intended to be fastened to a sliding board and to surround, at least partially, a sole and lateral sides of a boot, at least one lever (201, 301) that can move relative to the base and can interact with a retention element (44A, 44B) connected to a boot, the lever (201, 301) being able to move between a first retention position (P1) and a second clamping position (P2), the lever being able to retain the boot in the base when it is in its first position, the lever being able to transmit a downward force on the retention element when it is in its second position.

20 Claims, 10 Drawing Sheets

(56) References Cited

U.S. PATENT DOCUMENTS

| | | | | |
|---|---|---|---|---|
| 6,053,524 | A * | 4/2000 | Laughlin | A43B 5/0401 280/634 |
| 6,076,285 | A | 6/2000 | Caeran et al. | |
| 6,099,018 | A | 8/2000 | Maravetz et al. | |
| 6,347,805 | B1 | 2/2002 | Maravetz et al. | |
| 6,416,074 | B1 | 7/2002 | Maravetz et al. | |
| 6,443,465 | B1 | 9/2002 | Maravetz et al. | |
| 6,557,884 | B1 | 5/2003 | Maravetz et al. | |
| 9,873,033 | B2 * | 1/2018 | Debney | A63C 10/106 |
| 2002/0000708 | A1 * | 1/2002 | Gignoux | A63C 10/103 280/624 |
| 2002/0089150 | A1 | 7/2002 | Musho et al. | |
| 2003/0164605 | A1 | 9/2003 | Maravetz et al. | |
| 2003/0197350 | A1 * | 10/2003 | Laughlin | A63C 10/24 280/624 |
| 2004/0017063 | A1 * | 1/2004 | Gignoux | A63C 10/10 280/625 |
| 2004/0155433 | A1 * | 8/2004 | Sanders | A63C 10/106 280/624 |
| 2004/0232658 | A1 * | 11/2004 | Poscich | A63C 10/04 280/618 |
| 2017/0216710 | A1 | 8/2017 | Debney | |

FOREIGN PATENT DOCUMENTS

| | | | |
|---|---|---|---|
| WO | 02092176 | A1 | 11/2002 |
| WO | 2007027017 | A1 | 3/2007 |
| WO | 2012058451 | A1 | 5/2012 |

* cited by examiner

FASTENING DEVICE FOR FASTENING A BOOT TO A SLIDING BOARD

This application claims priority of French patent applications Nos. FR1905496 filed May 24, 2019 and FR1908869 filed Aug. 2, 2019, the content of each of which is hereby incorporated by reference herein in its entirety.

FIELD OF THE INVENTION

The invention relates to a fastening device for fastening a boot to a sliding board, in particular to a sliding board for sliding on snow, particularly to a snowboard. The invention also relates to a boot intended to be fastened to a sliding board. Lastly, the invention relates to a fastening system for snowboarding, comprising such a fastening device and such a boot.

PRIOR ART

Snowboarding, or snow surfing, consists in descending snow-covered pistes on a sliding board to which the user's two boots are fastened. To fasten a boot, use is generally made of a fastening device comprising a support fastened to the sliding board and several flexible straps fastened to the support at their ends and passing over the boot. The support, which is generally made of plastic, at least partially surrounds the sole, the rear and the sides of the boot. The fastening generally comprises two straps, one of which passes over the instep while the other passes over the front of the boot. These straps press the boot firmly onto the bottom of the support. Each strap is made up of two parts that can interact with one another via a tightening or clamping means so as to hold the foot in place securely.

To fasten a boot to the sliding board, the user thus generally has to position his foot on the bottom of the support of the fastening then successively clamp the straps of the fastening. This a fiddly operation that often requires the user to sit down in the snow to fit his boots to the sliding board. Yet it is an operation that has to be redone several times during a day's snowboarding since riding on the mechanical lifts generally requires at least one of the two feet to be removed from the board. The level of clamping obtained after each manipulation can vary. The user thus has to get used to snowboarding with a level of comfort that can vary each time the clamping and unclamping operation is performed. Moreover, existing straps are made of flexible plastic and can break, which can be particularly dangerous when the user is descending a ski piste at high speed.

Patent EP0885036 discloses fastenings commonly known as "step-in" fastenings, which can interact with a fastening device integrated under the sole of the boot. These fastenings make fitting the boots quicker when the sole is not clogged with snow. However, when there is snow or ice on the fastening device under the sole, this can make fitting the boots more difficult or even impossible. It is thus often necessary to thoroughly clean the sole so as to be able to fasten the boot on the sliding board.

Furthermore, with such a fastening system the foot is held in place via the sole and not the top of the foot or the instep as with conventional fastening systems, and users to not like how this type of fastening feels. To be specific, the transmission of forces from the foot to the sliding board is less accurate and the sensations felt by the user are not as good. The level of comfort afforded by such fastenings may also be adversely affected by compression points owing to the fastening mechanism, positioned under the foot of the user.

PRESENTATION OF THE INVENTION

The invention aims to provide a fastening system for fastening a boot to a sliding board that overcomes the above drawbacks and improves the known prior art fastening systems.

More specifically, a first aim of the invention is a fastening device which is practical to use and makes it possible to fasten or release a boot on/from a sliding board quickly and easily.

A second aim of the invention is a fastening device allowing optimal transmission of the pushing action by a user to a sliding board to control the movement of the latter.

A third aim of the invention is a fastening device which is comfortable on the foot of the user.

A fourth aim of the invention is an automatic fastening device that can be used even when snow is liable to build up under the sole of a boot.

SUMMARY OF THE INVENTION

To this end, one subject of the invention is a fastening device for fastening a boot to a sliding board, comprising:

- a base intended to be fastened to a sliding board and to surround, at least partially, a sole and lateral sides of a boot,
- at least one lever that can move relative to the base, the lever being able to interact with a retention element connected to a boot, the lever being able to move between a first retention position and a second clamping position, the lever being able to retain the boot in the base when it is in its first position, the lever being able to transmit a downward force on the retention element when it is in its second position.

According to one mode of implementation, the lever comprises a gripping element for moving the lever from its first position into its second position in the direction of clamping.

According to one mode of implementation, the lever is arranged along a lateral side of the base, and the lever being able to interact with a retention element extending laterally from the boot.

According to one mode of implementation, the lever comprises a first bearing surface that can vertically retain the lateral retention element, the first bearing surface being in the form of a cam and/or the first bearing surface comprising a first portion intended to bear against the retention element when the lever is in its first position, the first bearing surface comprising a second portion intended to bear against the retention element when the lever is in its second position, the second portion being separate from the first portion.

According to one mode of implementation, the lever can rotate about a hinge pin, the hinge pin extending parallel to a transverse axis of the fastening device, the distance separating said first portion from the hinge pin being strictly greater than the distance separating said second portion from the hinge pin.

According to one mode of implementation, the lever comprises an opening, an edge of the opening forming said first bearing surface.

According to one mode of implementation, the first bearing surface of the lever is in the shape of an arc of a circle, off-centre relative to the hinge pin,
and/or the first bearing surface of the lever comprises a row of notches, each notch defining a stable clamping position of the lever.

According to one mode of implementation, the base comprises a lateral side having a guide groove oriented and open forwards and upwards.

According to one mode of implementation, the lever comprises a second bearing surface forming a fitting ramp, the second bearing surface being intended to interact with the retention element so as to move the lever from an initial position into a third retracted position.

According to one mode of implementation, the fastening device comprises a return means, the return means exerting a force on the lever tending to move the lever from its third retracted position into its initial position.

According to one mode of implementation, the lever comprises a release handle, a force oriented downwards on the release handle tending to move the lever into its third retracted position.

According to one mode of implementation, the base comprises a stop means positioned at the front of the base, the stop means being able to interact with a mating element of the boot.

According to one mode of implementation, the fastening device comprises a first lever that can move relative to the base and a second lever that can move relative to the base, the first lever being able to interact with a first retention element connected to a boot, the second lever being able to interact with a second retention element connected to a boot, the first lever being able to move between a first retention position and a second clamping position, the second lever being able to move between a first retention position and a second clamping position, the first lever and the second lever being able to retain the boot in the base when they are in their first position, the first lever and the second lever being able to transmit a downward force on the first retention element and on the second retention element, respectively, when they are in their second position.

According to one mode of implementation, the first lever is rigidly secured to the second lever, and the first lever and the second lever can rotate about one and the same hinge pin, said hinge pin being oriented parallel to a transverse axis of the fastening device, said pin being arranged at the rear of a baseplate of the base.

The invention also relates to a boot for sport comprising a strap assembled slidingly, the strap surrounding an instep of the boot, the strap comprising a first free end, extending on a first side of the instep, and a second free end, extending on the other side of the instep, the first end comprising a first lateral retention element intended to interact with a first lever of a fastening device as previously defined and the second end comprising a second lateral retention element intended to interact with a second lever of the fastening device so as to clamp the boot against the fastening device.

According to one mode of implementation, the first retention element extends transversely in a zone of the boot delimited by a rear end of the boot, a lower edge of the boot and a point on the boot intended to be positioned at most at around 20 mm of an inner ankle bone of a user, and/or the second retention element extends transversely in a zone of the boot delimited by a rear end of the boot, a lower edge of the boot and a point on the boot intended to be positioned at most at around 20 mm of an outer ankle bone of a user.

The invention further relates to a fastening system comprising:

a fastening device as previously defined, and a boot for sport as previously defined.

PRESENTATION OF THE FIGURES

These aims, features and advantages of the present invention will be described in detail in the following description of a particular embodiment which is provided without intended limitation with reference to the attached figures, in which.

DETAILED DESCRIPTION

Figure 1:
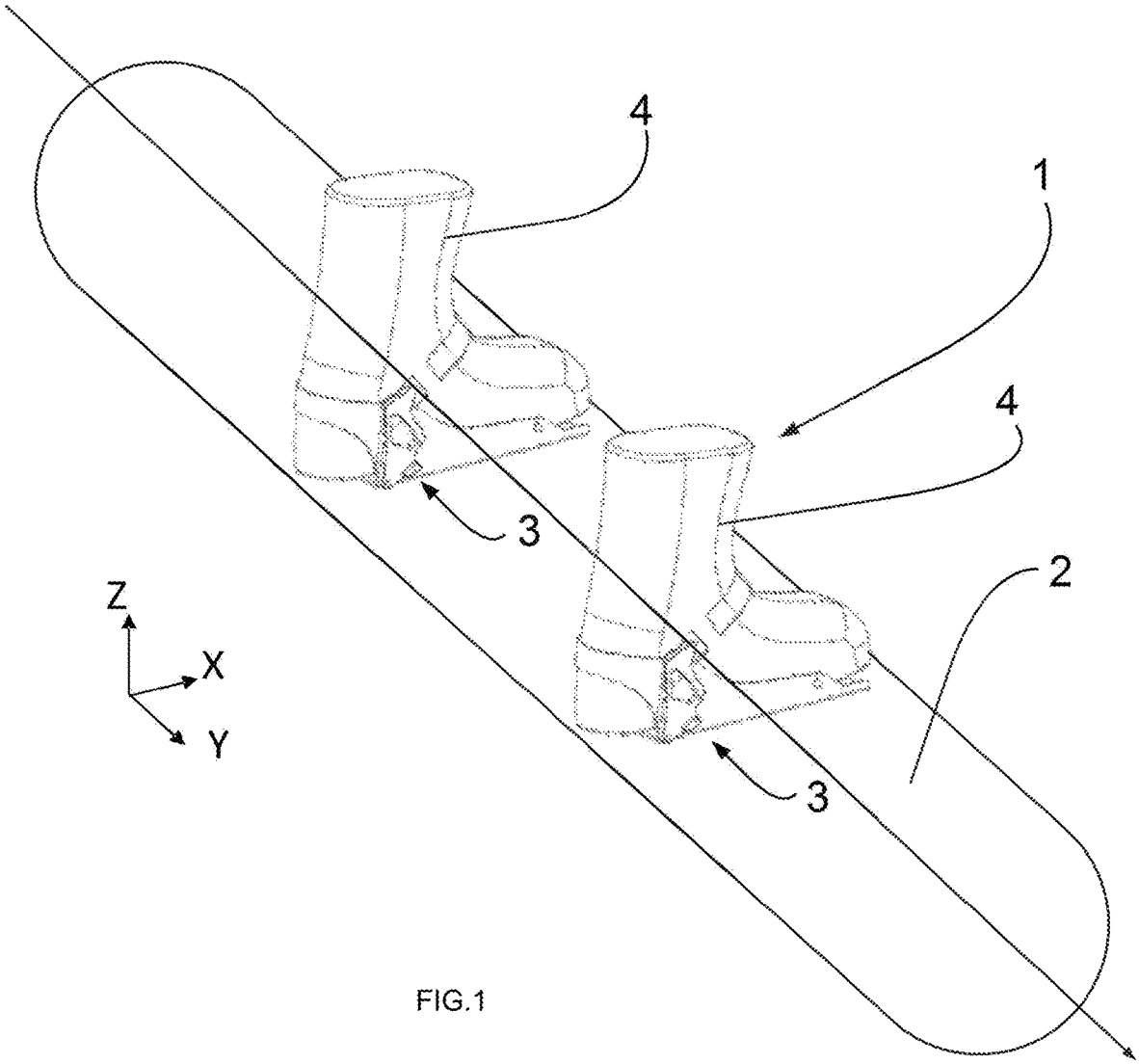
FIG. 1 is a schematic view of a piece of snowboarding equipment according to an embodiment of the invention.

FIG. 1 schematically shows a piece of snowboarding equipment 1 according to an embodiment of the invention. The equipment 1 comprises a sliding board 2, two fastening devices 3 according to an embodiment of the invention and a pair of boots 4 according to an embodiment of the invention. The sliding board has an elongate shape, extends generally in a plane and has raised front and rear ends. A first face of the sliding board or lower face is intended to come into contact with a snow-covered surface, while the two fastening devices are fastened to the other face of the sliding board, i.e. to the upper face. The two fastening devices are used to fasten the two boots 4 of a user to the sliding board 2. The two fastening devices and hence the two boots are fastened substantially perpendicularly to the axis along which the sliding board extends. As an alternative and most commonly, the fastening devices may be fastened in a different way: for example, they may be fastened in such a way that the fastening devices and hence the two boots make an angle other than a right angle with the axis along which the board extends. It is also possible for the user to adjust the orientation of each fastening device on the board. As an alternative, the fastening devices could be fastened side by side as for a monoski or one behind the other as for a skwal. According to yet another alternative, the two fastening devices could be each fastened to a different sliding board such as for skiing. The equipment could comprise only a single fastening device according to the invention, in which case the other boot could be fastened to the sliding board via a fastening device according to the prior art. In the text below, the aim is to describe a particular fastening device interacting with a boot. This boot may be either a left boot or a right boot.

In this document, the longitudinal axis X of the fastening device is defined as the axis along which the foot of the user extends from the heel to the toes when the foot of the user is in place in the fastening device. The terms "front" and "rear" are defined in relation to the longitudinal axis X, the rear designating the heel end and the front designating the toe end. The transverse axis Y designates an axis perpendicular to the axis X and oriented from left to right as seen by the user. For the purposes of the description it is assumed that the device is mounted on a sliding board resting on horizontal ground. The axis X and the axis Y thus define a horizontal plane. The axis Z designates the vertical axis, perpendicular to the axes X and Y. The axis Z is oriented from bottom to top. The axes X, Y and Z constitute an orthogonal coordinate system.

Figure 2:
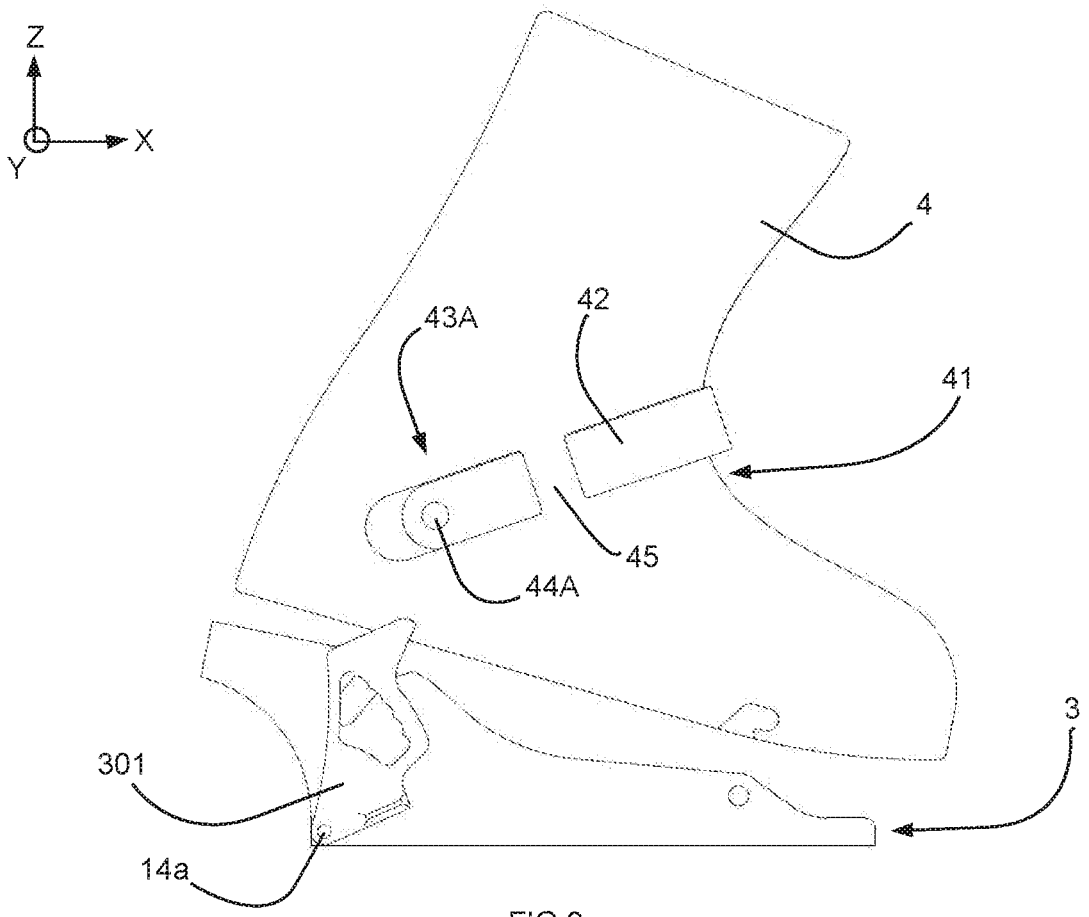
FIG. 2 is a side view of a boot and a fastening device according to a first embodiment of the invention, with the boot about to be fastened to the fastening device.

With reference to FIG. 2, the boot 4 is an upright boot. It surrounds the foot, the ankle and the bottom of the leg of the user. In particular, the boot 4 surrounds the instep of the user, i.e. the upper part of the foot above the ankle joint. The instep 41 of the boot designates the part of the boot that covers the instep of the user, i.e. a curved part of the anatomy, positioned in the area of the ankle joint, between the foot and the bottom of the leg. The boot 4 comprises a strap 42, or thong, assembled slidingly relative to the rest of the boot and encircling the instep 41 of the boot from left to right. In particular, the strap slides relative to a cuff of the boot, i.e. an external part of the boot which covers the foot. This strap 42 covers the instep 41 of the boot. It is connected to and forms an integral part of the boot. However, it would not be departing from the scope of the invention if this strap were added to a boot initially not provided with a strap and rigidly secured to this boot, for example by a harness supporting the strap.

Figure 3:
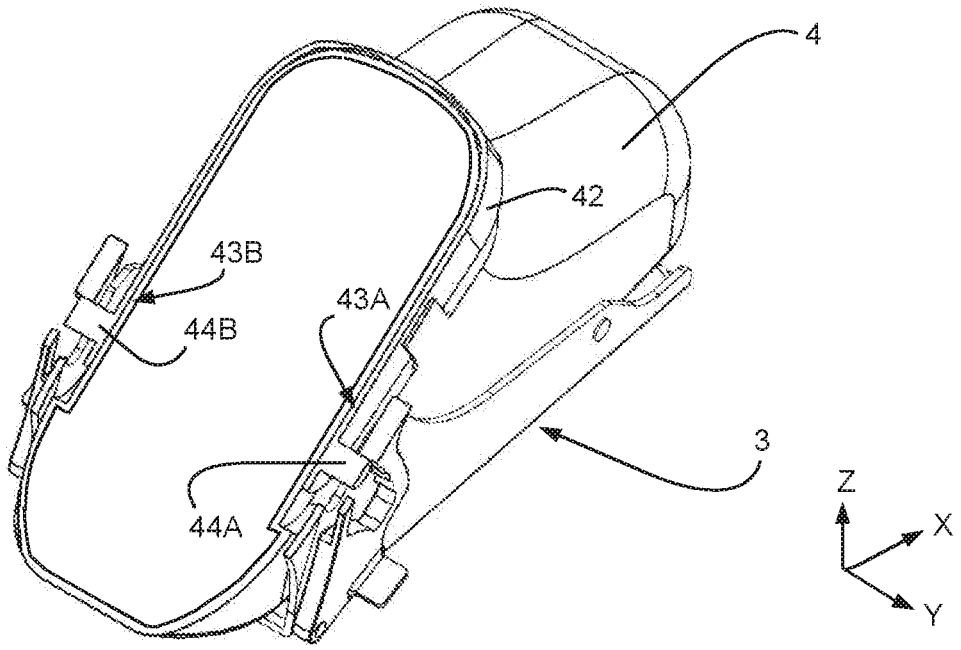
FIG. 3 is a sectional view of the boot and the fastening device according to the first embodiment, the section being taken parallel to a plane in which the strap of the boot extends.

FIG. 3 shows a sectional view of the boot 4 and of the fastening device 3 along a plane PC1 parallel to a median plane of the strap. This plane PC1 is in particular shown in FIG. 8. The strap 42 may be generally U shaped, so as to fully surround the instep 41. It comprises a first free end 43A extending on a first side of the instep, over a lateral side of the boot, and a second free end 43B extending on the other side of the instep, over the other lateral side of the boot. The ends 43A, 43B may be substantially positioned in the region of the inner and outer ankle bones of the foot of the user, these ends being substantially oriented towards a lower rear corner of the boot, at the interface between the sole and the vertical part along the heel. The plane PC1 makes, with the horizontal plane, an angle A1 that may be for example between 30° and 70°, in particular between 40° and 60°, preferably around 50°.

The first end 43A is provided with a first lateral retention element 44A. The second end 43B is provided with a second lateral retention element 44B. The two lateral retention elements 44A, 44B are therefore substantially positioned in a zone ZR (shown in FIG. 10) of the boot delimited by the rear end of the boot, the lower edge of the boot and two points on the boot positioned substantially facing the inner ankle bone and the outer ankle bone, respectively, of the foot of the user, or possibly positioned forward at most at 20 mm of the ankle bones. In other words, the zone ZR extends laterally substantially on either side of the heel of the boot in an area extending in one rear third of the shoe, defined relatively to the total length of the sole of the shoe. More particularly, the first lateral retention element 44A and the second lateral retention element 44B may take the form of a lug extending transversely to the strap 42 on a side of the boot, outwards from the boot. The lug may in particular have a cylindrical shape with its axis of revolution substantially parallel to the axis Y. As an alternative, the lateral retention element could have a different shape, such as a mushroom shape. The strap 42 can slide parallel to the direction in which it extends. The strap is forced to move at least according to this sliding movement. For example, its sliding movement may be guided by loops 45 which cover it locally, for example two loops each positioned on the lateral sides of the boot. Thus, the strap may move slightly upwards and forwards when the boot is not secured to the fastening device so as not to impede walking, but may slide downwards and rearwards when the strap is secured to the fastening device. The strap 42 is then clamped by this fastening device so as to be pressed against the upper part of the boot, at the instep. Moreover, these loops prevent the strap from twisting on itself. The loops may be attached on the boot or be formed by the cuff of the boot. It would not be departing from the scope of the invention if other means for sliding and guiding of the strap on or in the boot were to be selected. As an alternative, the boot could be designed differently: for example, the lateral retention elements 44A, 44B could be fastened not directly to a strap but directly to the boot and then connected to the strap by means of a cable, these lateral retention elements also sliding relative to the boot.

The sliding translational movement of the strap 42 may allow the boot to have a slight rolling movement from left to right about the axis X, when the boot is secured to the fastening device. In addition, the strap 42 may also have an additional degree of freedom of movement, for example a rotation from front to rear or vice versa to facilitate the rolling movement of the boot secured to the fastening device.

According to an alternative embodiment not shown, the retention elements 44A, 44B could be fastened not to a strap of the boot but directly to a cuff of the boot, to a sole of the boot or indeed to any other part of the boot, in particular on a reinforcement surrounding the heel. The retention elements would then be able to move relative to the rest of the boot only within the limits of the flexibility of the materials used to make the boot. The boot could possibly comprise reinforcements to limit the movement of the retention elements. According to this alternative embodiment, the retention elements may have a shape and/or position substantially identical to the shape and/or position of the retention elements which are integral with the strap, described above.

Figure 4:
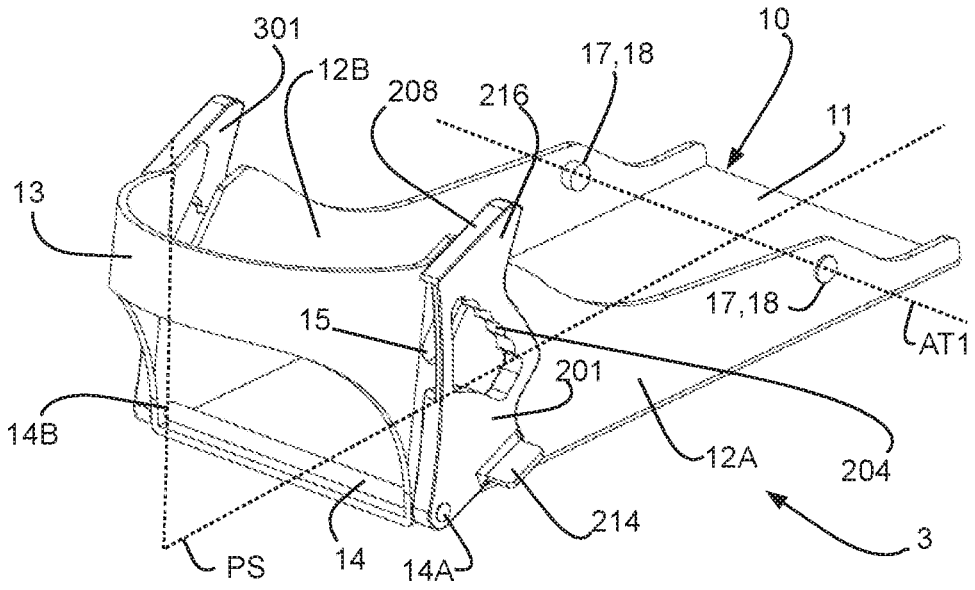
FIG. 4 is a perspective view of the fastening device according to the first embodiment.

The fastening device 3 is in particular shown in perspective in FIG. 4. It comprises a base 10, a first lever 201, and a second lever 301, separate from the first lever. The first lever 201 can interact with the first lateral retention element 44A and the second lever 301 can interact with the second lateral retention element 44B to clamp the boot against the base, in particular to clamp the strap 42 on the instep 41 of the boot. The first lever 201 forms a means for attaching the first retention element 44A and the second lever 301 forms a means for attaching the second retention element 44B.

The base 10 is fastened to the sliding board, for example by means of screws screwed into the thickness of the sliding board, or by any other rapid locking/unlocking means known in the prior art. In particular, the base 10 or more precisely the lower plate of the base or baseplate 11 may have a circular opening (not shown), intended to receive a circular disc for retaining the base 10 on the sliding board. The base 10 may also, in a known manner, be easily positioned angularly relative to the board. The base 10 surrounds, at least partially, a sole, a rear portion and lateral sides of the boot 4. To this end, the base 10 comprises a baseplate 11 on which the lower face of the sole of the boot 4 is intended to bear. The baseplate extends parallel to the sliding board and is positioned bearing thereon. The base 10 further comprises two lateral flanks 12A, 12B or lateral sides 12A, 12B extending on either side of the baseplate 11, each in a plane parallel to the axes X and Z. The lateral flanks make it possible to block the boot laterally. The two lateral flanks are spaced apart from one another in such a way as to be able to accommodate the sole of the boot. The lateral flanks may have a height sufficient so as to bear on the sides of the sole of the boot. In particular, they may have a height that increases from front to rear. They are connected to one another at the rear by an arch 13 in the shape of an arc of a circle which is raised relative to the baseplate 11. The arch 13 is intended to receive the rear of the boot and may be positioned substantially at the same height as the user's Achilles tendon. The arch 13 forms a rear stop for the boot. As an alternative, the fastening device could comprise any other type of rear stop means to prevent a rearward movement of the boot. A rear opening is defined at the rear of the base by a lower contour of the arch, the two lateral flanks and the baseplate. When the boot is in place in the fastening device, the heel of the boot may optionally emerge through this rear opening. The arch 13 may be topped by a vertical reinforcement or spoiler (not shown), extending at the rear of the boot substantially along the axis Z, providing a bearing surface for the boot at the rear of the base.

The first lever 201 is arranged along a lateral side (in this case the right-hand lateral side) of the base 10 and towards the rear of the base. It can be seen in FIG. 4 that the first lever 201 is arranged at the rear of the lateral flank 12A of the base and on the outside thereof. The lateral flank 12A is thus interposed between the lever 201 and the boot 4. Likewise, the second lever 301 is arranged symmetrically at the rear and along an opposite lateral side of the base, i.e. along the lateral flank 12B of the base (in this case the left-hand lateral side). Preferably, the first lever 201 and the second lever 301 may be positioned in a rear half of the fastening device so as to be able to interact with the retention elements 44A, 44B, themselves arranged in the zone ZR of the boot.

The two levers 201, 301 can move between an initial position P0, a first position P1 and a second position P2. In the various alternatives shown, the initial position P0, for fitting the boot or in which the boot is ready for fitting, and the first position P1 referred to as the retention position are identical but they could also be different. In particular, the lever 201 and the lever 301 can rotate about one and the same hinge pin 14. The hinge pin 14 is oriented parallel to the transverse axis Y. The hinge pin 14 is arranged at the rear of the baseplate 11 of the base, in the lower portion of the base, in such a way as to pass underneath the sole of the boot when the sole bears on the baseplate 11. The hinge pin 14 may be guided in rotation by virtue of openings forming bearings in the base 10. The lever 201 is rigidly secured to the lever 301 via the hinge pin 14. More specifically, the lever 201 is rigidly secured to the hinge pin 14 via a first end 14A of the hinge pin 14 and the lever 301 is rigidly secured to the hinge pin 14 via a second end 14B of the hinge pin 14. The hinge pin 14 thus forms a connection means between the two levers 201, 301. Thus, a movement of the lever 201 causes an identical movement of the lever 301 and vice versa. The user may thus choose to manipulate either the lever 201 or the lever 301, depending on which movement is more comfortable for him.

As an alternative, the two levers could be independent of one another, i.e. they could be moved between their various positions independently of one another and they could move about two different transverse pins, oriented along the axis Y and mounted on each of the lateral flanks 12A, 12B of the base. If the two levers are independent, each foot is then held on the board by two independent attachment means.

As can be seen in FIG. 4, the fastening device may be symmetrical along a plane of symmetry PS oriented parallel to the longitudinal axis X and to the vertical axis Z. Thus, the same fastening device may be used either for fastening a left boot or for fastening a right boot to the sliding board. In other embodiments not shown, the fastening device may not be symmetrical about a median plane and have one shape suitable for a left boot and another shape suitable for the right foot. In the text below, the aim is to describe only the first lever 201, the second lever 301 being symmetrical to the first lever. For ease of reading, the first lever 201 will simply be called a "lever" and the first lateral retention element 44A will simply be called a "retention element".

Figure 5:
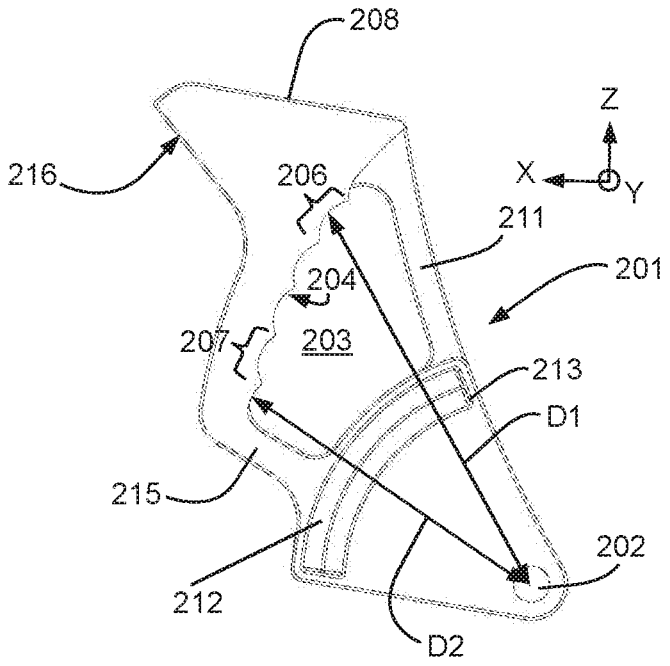
FIG. 5 is a side view of a lever of the fastening device according to the first embodiment, from the inside of the lever.
Figure 6:
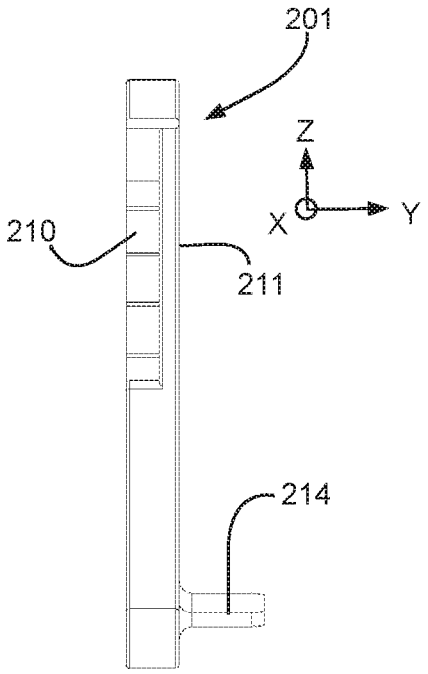
FIG. 6 is a view from the rear of the lever of the fastening device according to the first embodiment.
Figure 7:
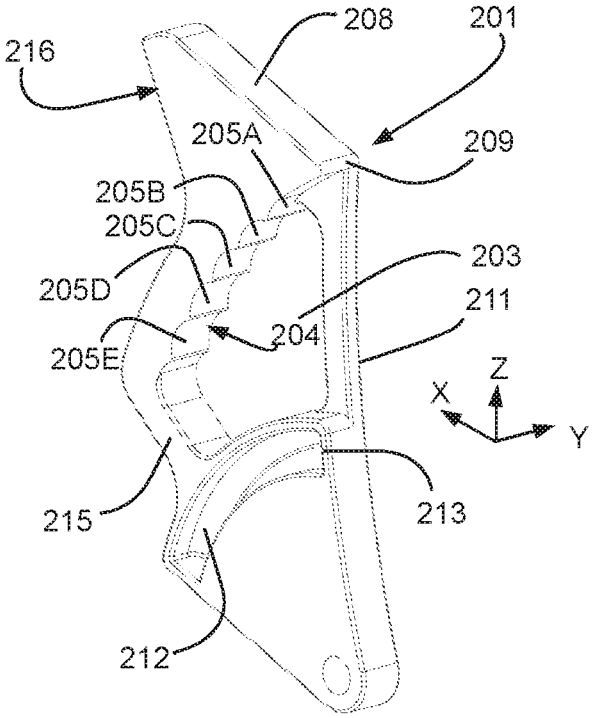
FIG. 7 is a first perspective view of the lever of the fastening device according to the first embodiment.

The lever 201 is shown in greater detail in FIGS. 5 to 7. Advantageously, the lever may be a one-piece element. II may be made of metal to give it considerable and long-lasting solidity and rigidity, but other rigid materials such as fibre-reinforced plastic could also be used. It extends generally in a plane perpendicular to the axis Y. The lever 201 is mounted such that it can move on the base via the hinge pin 14. The hinge pin 14 is fastened to the lever 201 by engagement in a circular opening 202, located on a lower edge of the lever 201. This circular opening 202 receives the end 14A of the hinge pin 14. The lever 201 further comprises an opening 203 with one edge forming a first bearing surface 204 or cam surface, which can interact with the retention element 44A. The opening 203 is an opening passing through the thickness of the lever 201 along the transverse axis Y. The edge forming the first bearing surface 204 is an upper edge of the opening 203 of the lever 201. In particular, the retention element 44A is held vertically in the upward direction when it bears against a portion of the bearing surface 204 forming a cam. This bearing surface 204 is perpendicular to a plane comprising the axis X and the axis Z. The position of the retention element 44A along the bearing surface 204 is visible from the outside, which in particular makes it possible to check, quickly and easily, that the retention element is positioned correctly relative to the bearing surface 204. Moreover, the opening 203 facilitates the removal of any snow or ice that could accumulate on the bearing surface 204.

The bearing surface 204 is crenellated, i.e. it has a row of notches 205A, 205B, 205C, 205D, 205E positioned side by side. Each notch 205A, 205B, 205C, 205D, 205E has the shape of an arc of a circle, matching the cylindrical shape of the retention element 44A. Thus, each notch may define a stable retention and/or clamping position of the lever 201, in other words the forces exerted by the retention element on the lever cannot cause the lever to rotate, thereby opening the lever in the release direction D. More specifically, the selected inclination of the bearing surface 204 forming a cam surface and the position thereof relative to the hinge pin 14 of the lever 201 makes it possible, when a vertical upward force is applied by the retention element of the boot when snowboarding over the snow, to generate a force that tends to pivot the lever 201 rearwards, i.e. in the direction of closure and clamping. According to the embodiment shown, the first bearing surface 204 comprises five notches but this number could differ.

Two separate portions 206, 207 of the bearing surface 204 may be defined. The first portion 206 may be defined as the portion of the bearing surface corresponding to a first notch 205A and the second portion 207 may be defined as the portion of the bearing surface corresponding to a fourth notch 205D. As an alternative, the second portion could just as easily correspond to the notches 205B, 205C or 205E.

Figure 8:
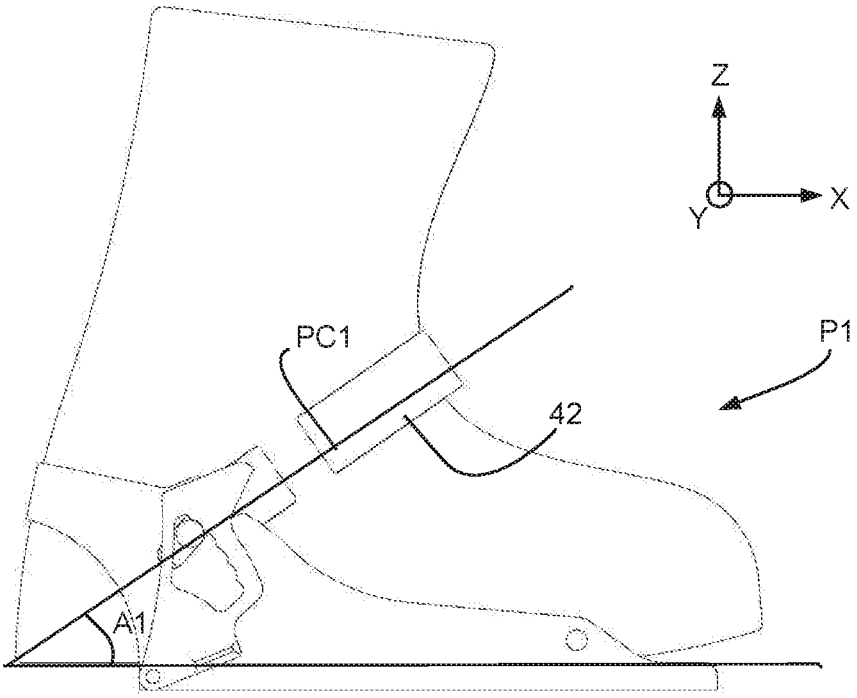
FIG. 8 is a side view of the boot and the fastening device according to the first embodiment, the boot being held in place vertically against a base of the fastening device, the lever being in a first position, referred to as the retention position.
Figure 9:
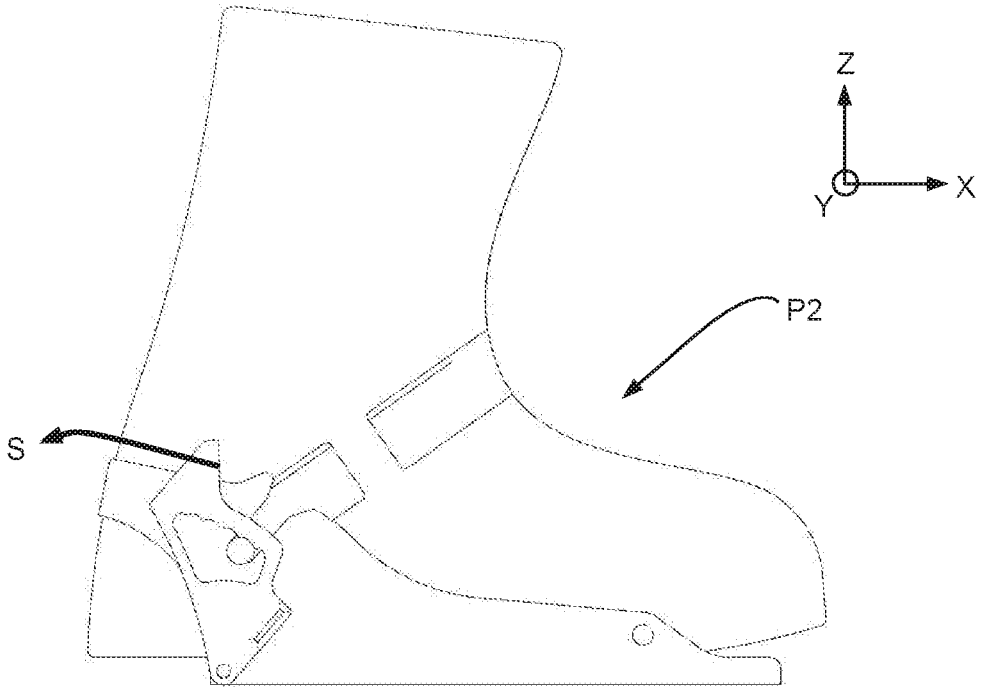
FIG. 9 is a side view of the boot and the fastening device according to the first embodiment, the boot being held in place vertically and clamped against the base, the lever being in a second position, referred to as the clamping position.

The first position P1, referred to as the retention position of the lever 201, is shown in particular in FIG. 8 and the second position P2, referred to as the clamping position of the lever, is shown in particular in FIG. 9. A rearward rotation of the lever brings the lever from its first position into its second position. The rotation of the lever in the direction of clamping is in particular shown by an arrow S in FIG. 9. The retention element 44A of the boot bears against the first portion 206 of the first bearing surface 204 when the lever is in its first position P1 and it bears against the second portion 207 when the lever is in its second position P2. When the lever is pivoted from the first position P1 into the second position P2, the zone where the retention element bears on the first bearing surface gradually moves from the first portion 206 to the second portion 207, in particular via the notches 205B and 205C.

As shown in FIG. 5, the distance D1 separating the first portion 206 from the hinge pin 14 is strictly greater than the distance D2 separating the second portion 207 from the hinge pin of the lever 201. From the first notch of the first portion to the last notch of the second portion, the distances separating these notches from the hinge pin of the lever 201 decrease, making it possible to bring the retention element of the boot towards the baseplate 11 of the base when the lever is pivoted in the direction of clamping S, rearwards. When the lever is in its first position, referred to as the retention position P1, the retention element 44A is generally in the first upper notch 206, the lever 201 retains the boot 4 and blocks its movement vertically upwards. This first position P1 is thus a retention position, i.e. the boot is held in place by the fastening device but is not yet clamped against the base. The sole of the boot may still have a degree of play with respect to the baseplate 11 or at least be only lightly pressed against the baseplate 11. The strap exerts little or no pressure on the instep of the user. This configuration is particularly comfortable but the boot is not clamped sufficiently firmly by the fastening device to allow the sliding board to be guided properly over the snow.

When the lever goes from the first position, referred to as the retention position P1, to the second position, referred to as the clamping position P2, the lever 201 and in particular the cam surface 204 exerts a force downwards and rearwards on the retention element 44A causing said retention element 44A to move downwards, in the direction of the baseplate 11 of the base 10. The retention element moves in a direction substantially perpendicular to the plane in which the sliding board and/or the baseplate 11 extends. The retention element 44A being itself also guided in a guide groove 15 in the base, inclined rearwards, as explained below, this retention element ultimately moves downwards and rearwards during clamping, when the lever 201 is rotated rearwards. Thus, the retention element 44A moves closer to the hinge pin 14. The strap 42 is stretched parallel to its direction of sliding, i.e. rearwards and downwards. The movement of the retention element thus causes clamping of the strap on the instep of the boot towards the base. The boot is pressed against the base and firmly held in place by the strap stretched over the instep 41. Advantageously, the lever may be able to move the retention element downwards, in the vertical direction, by a distance greater than or equal to 10 mm, in particular around 20 mm, when the lever is moved from its first position, referred to as the retention position P1, into its second position, referred to as the clamping position P2, the retention element thus moving closer to the upper face of the base and the lower face of the sole of the boot. In a preferred example, when the lever is in its first position, referred to as the retention position P1, the retention element is at around 70 mm from the lower face of the sole and hence from the upper face of the base 10. Then, when the lever is in its second position P2, referred to as the clamping position, the retention element is then at around 50 mm from the lower face of the sole and from the upper face of the base. The central axis of the retention element 44A is then located approximately at a distance of between 50 and 85 mm from the heel, preferably between 70 and 80 mm from the heel of the boot.

Incidentally, in the particular case where the retention elements are not fastened to a strap of the boot but to any other part such as the cuff of the boot, the rearward rotation of the lever results in a downward force being transmitted on the cuff. This force is transmitted to the sole of the boot which is then compressed against the baseplate 11 of the fastening device. The passage from the retention position P1 to the clamping position P2 is performed manually by the user by manually actuating the lever. This transition is obtained by manipulating the lever rearwards, in the direction of clamping S, as shown in FIG. 9. This manual action is performed in particular by taking hold of a gripping element 216 for clamping the lever 201. The gripping element 216 forms a handle that can be gripped by the hand. The gripping element 216 is located in the upper front part of the lever. Other actuation means could be envisaged, such as means with electronic assistance. Moreover, in the embodiments shown, the gripping element 216 for actuating clamping forms a single piece with the lever 201 bearing the cam surface 204, but it would not be departing from the scope of the invention if the gripping element 216 were an element distinct from the lever 201, such as a second lever mounted on the base and actuating the lever 201 bearing the cam and causing it to move in the direction of clamping. As the two levers 201 and 301 are coupled together by the hinge pin 14, the manual actuation of the lever 201 by the gripping element 216 thus automatically causes simultaneous rotation of the lever 301, and vice versa, in the direction of clamping S.

Several clamping positions P2 may be achieved depending on the desired level of clamping on the boot. The more the lever 201, which bears the cam surface for retention and clamping, is pivoted rearwards, the higher the level of clamping, i.e. the more the retention element of the boot moves downwards and moves closer to the upper surface of the base. Thus, the strap 42 is clamped increasingly firmly against the upper part of the boot in the area of the instep, the sole then being pressed against the baseplate 11 of the fastening element.

According to a second embodiment of the invention, shown in FIGS. 12 to 18, the first bearing surface of the lever does not comprise a succession of notches but a smooth profile in the shape of an arc of a circle. This arc of a circle shape is off-centre relative to the hinge pin 14 in such a way that different portions of the first bearing surface are positioned at different distances from the hinge pin 14. The bearing surface thus forms a cam on which the retention element 44A bears. Rotation of the lever from its first position into its second position then causes a gradual, smooth movement of the retention element rearwards and downwards, clamping the strap 42. The position of the centre of the arc of a circle forming the first bearing surface is thus chosen such that the tensile force exerted by the strap does not cause undesired rotation of the lever. The position of the cam surface of the lever 201, 301 is located substantially above the hinge pin of the lever. It would not be departing from the scope of the invention if the lever bearing the cam surface were rotationally mounted on one of the sides of the base at the top and if the cam surface were then positioned below the hinge pin of the lever.

Figure 10:
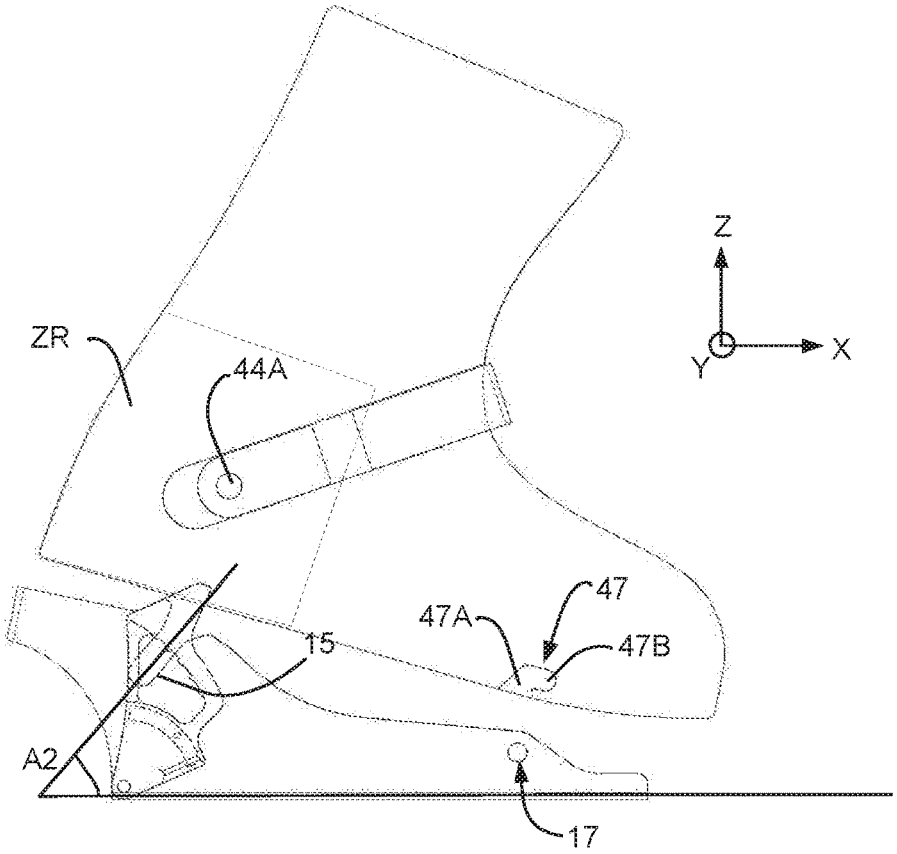
FIG. 10 is a transparent side view of the boot and the fastening device according to the first embodiment, the boot being in the released position and about to be fastened to the fastening device.

With reference to FIG. 10, the base 10 further comprises two guide grooves 15, or guide slots, emerging, in other words opening out, upwards, each positioned on each lateral flank 12A, 12B, of the base, in the rear portion of the fastening device. Each guide groove 15 is straight and inclined forwards and upwards. The guide groove makes it possible to guide the retention element 44A as the boot is put in place in the base, or against the base, and forces the strap 42 to move rearwards and downwards. The guide groove 15 also keeps the movement of the retention element 44A parallel to the axis along which the guide groove extends when the lever is moved between its first position, referred to as the retention position P1, and its second position, referred to as the clamping position P2. The strap is therefore stretched in the direction of the guide groove 15. This also prevents the clamping of the lever, performed via the gripping element 216, from transmitting forces on the strap perpendicularly to its direction of sliding. The guide groove 15 is in the form of a cut-out made in a rear zone of the lateral flank 12A of the base, and emerging at the upper edge of this lateral flank. The guide groove may be inclined relative to the longitudinal axis X by an angle A2 substantially similar to the angle A1 made by the strap 42 with the longitudinal axis X. The angle A2 may thus be for example between 30° and 70°, in particular between 40° and 60°, preferably around 50°. The guide groove is sufficiently long that, even in the position of maximum clamping, the retention element 44A or lug does not come into contact with the bottom of the guide groove. In another embodiment not shown, the guide groove 15 could, instead of being straight, be curvilinear and in particular be in the shape of an arc of a circle with the centre forming a point of front attachment of the boot 17, 18 as described below. Preferably, the groove 15 may be dimensioned in such a way as to have a width that is barely greater than the width of the retention element, thereby improving its guiding function.

When the lever forming a cam is in its initial position P0 for fitting the boot, the lever 201 is juxtaposed with the guide groove 15, although the retention element cannot be engaged therein without the lever 201 being moved. In the first position referred to as the retention position P1, or in the second position referred to as the clamping position P2, or in any intermediate position between the first position P1 and the second position P2, the lever is also juxtaposed with the guide groove 15, the retention element being then engaged in the guide groove 15. Thus, the lever 201 forming a cam laterally covers at least a portion of the guide groove 15 (i.e. it covers at least a portion of the guide groove according to a transverse projection of the lever 201 on the lateral flank 12A which includes the guide groove 15). To be specific, the retention element 44A of the strap 42 extends in the transverse direction beyond the lateral flank of the base and comes into interference with an upper edge of the lever when the latter is in its first position.

Figure 13:
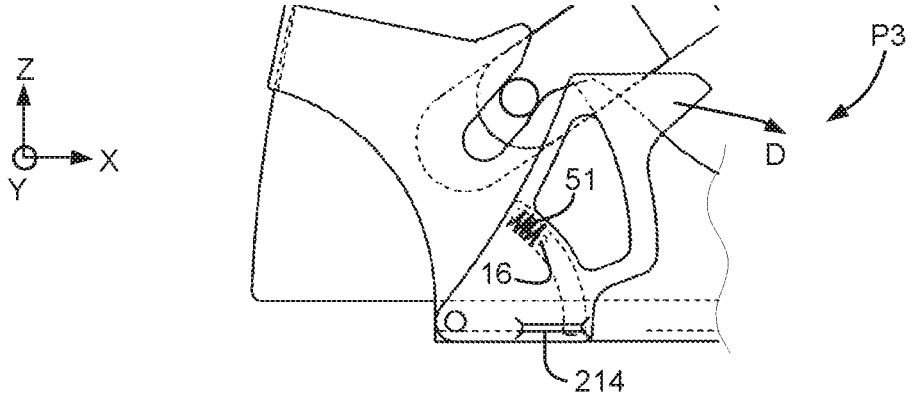
FIG. 13 is a partial transparent side view of the boot and the fastening device according to the second embodiment, the lever being in a third position, referred to as the retracted position.
Figure 14:
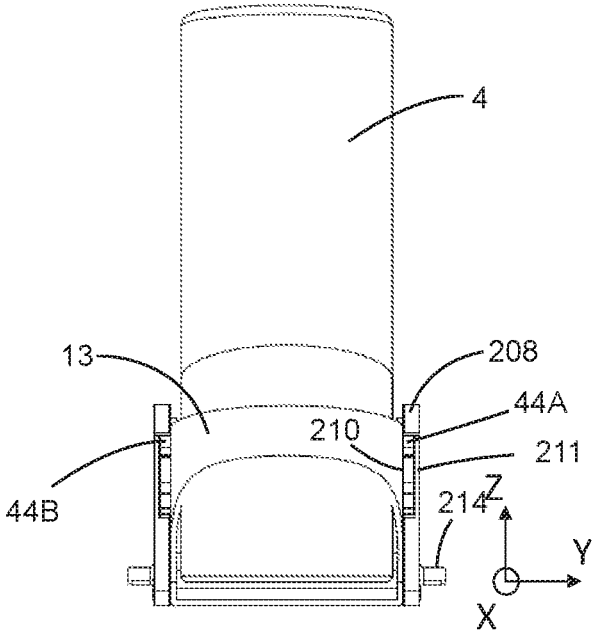
FIG. 14 is a view from the rear of the boot and the fastening device according to the second embodiment.
Figure 18:
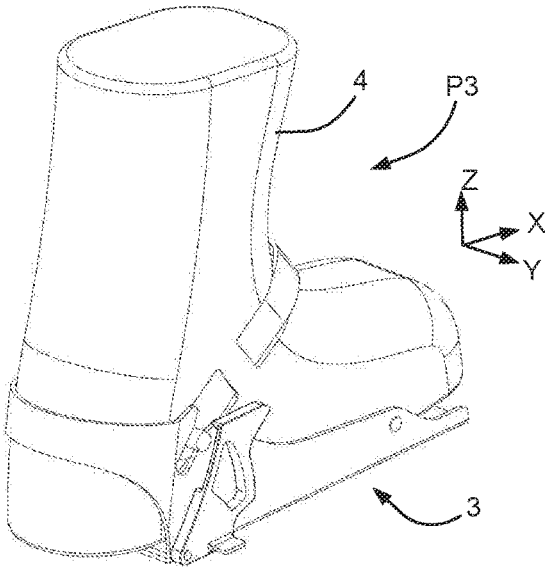
FIG. 18 is a perspective view of the boot and the fastening device according to the second embodiment, the lever being in its third position, referred to as the retracted position.

To allow the engagement, or in other words the fitting, of the boot in the fastening device or the release of the boot from the fastening device, the lever can be moved into a third position P3, referred to as the retracted position, which is different to the initial position P0, the first position P1 and the second position P2. This retracted position P3 is shown in particular in FIGS. 13 and 18. In this position, the lever is offset relative to the guide groove 15, i.e. it no longer covers this guide groove 15 laterally, and the retention element may be freely engaged in or disengaged from the guide groove, without interfering with the lever. The boot is can thus be engaged against the base to allow it to be fitted, or disengaged from the base to allow it to be released, when the lever is in its third position P3, referred to as the retracted position. Incidentally, FIGS. 13 and 18 show a lever having a first bearing surface 204 or cam surface according to the second embodiment of the invention. The same principle of course applies to a lever in which the first bearing surface or cam surface comprises notches.

The third position P3, referred to as the retracted position of the lever, corresponds to a position in which the lever is pivoted forwards from the initial position P0. The initial position of the lever P0 is the position in which the lever is prior to fitting of the boot. According to the embodiment shown, the initial position of the lever P0 is identical to the retention position P1 of the lever. The initial position P0 differs from the retention position P1 by the fact that the lateral retention element 44A or lug is not engaged in the groove 15 and hence is not bearing against the bearing surface 204 in the initial position P0, whereas it is in the retention position P1. In the initial position P0, the boot is still out of the fastening device. Compared to the retention position P1 or compared to the initial position P0, the retracted position P3 is obtained by rotating the lever in the direction of rotation for release D, as shown in FIG. 13. Thus, the lever systematically goes via the initial position P0 or via the first position, referred to as the retention position P1, when it is manipulated between the second position, referred to as the clamping position P2, and the third position, referred to as the retracted position P3. Thus, the lever forming a cam can move in two opposite directions of rotation, one in the direction of clamping S and the other in the direction of release D. In the embodiment proposed, the first position, referred to as the retention position P1, also corresponds to the initial position P0 in which the fastening device is ready for the boot to be fitted. It would not be departing from the scope of the invention if the initial position P0 were different to the retention position P1, in which case the initial position P0 of the lever would preferably be positioned between the retracted position P3 and the retention position P1.

Figure 11:
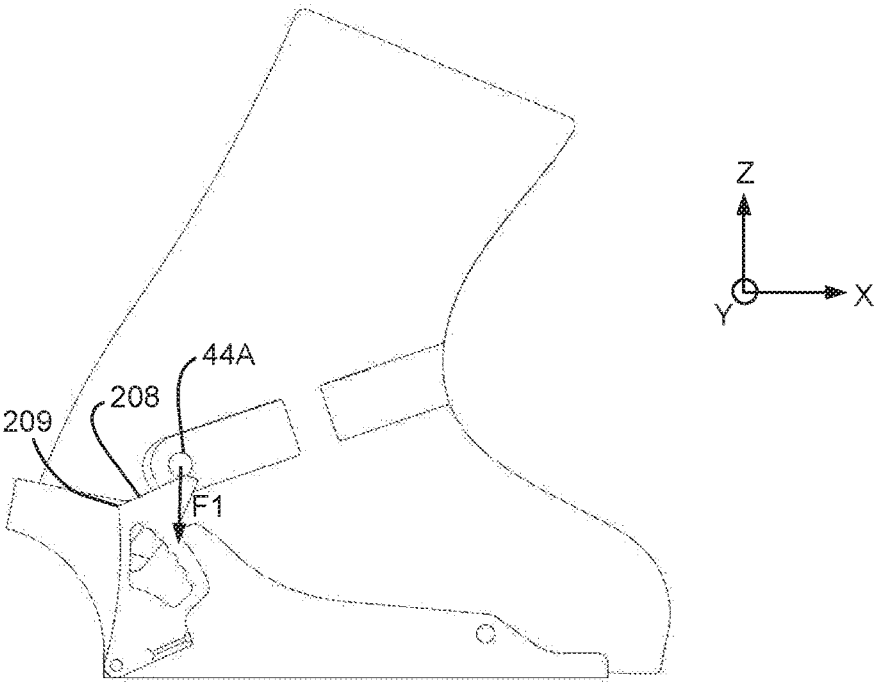
FIG. 11 is a side view of the boot and the fastening device according to the first embodiment, the front of the boot being engaged in the fastening device.

To allow the lever to be rotated from the initial position P0 into the third position P3, the boot not being fitted in the fastening device, the lever 201 forming a cam comprises a second bearing surface 208 or fitting ramp, arranged on an upper edge of the lever. The second bearing surface 208 is intended to interact with the retention element 44A of the boot so as to move the lever into its third position and allow automatic fitting of the boot in the fastening device. More particularly, as shown in FIG. 11, when the boot approaches the fastening device, the retention element 44A comes into contact with the second bearing surface 208 and exerts on the lever a force F1 oriented downwards. The point of contact of the retention element 44A on the bearing surface is positioned forward of the hinge pin 14. The force F1 thus causes a forward rotation of the lever, in the direction of release D. As the lever pivots forwards and as the heel of the boot gets closer to the baseplate of the base, the retention element 44A slides along the second bearing surface 208 or fitting ramp, as far as the rear end 209 thereof. The lever is thus sufficiently pivoted forwards for the retention element 44A to enter the guide groove 15 of the base. The lever is then free to return to its first position, referred to as the retention position P1, under the elastic return force exerted by a return spring on the lever, the retention element then being blocked in the upward direction by the cam surface 204 of the lever 201. The return of the lever to this first position is not impeded by the retention element 44A, which projects beyond the outer lateral side of the base, because the lever has a rear opening 210, shown in particular in FIG. 6 or 14. The rear opening 210 is formed by a recess made in the thickness of the lever bearing the cam, on its inner face, facing the lateral flank of the base 10. This rear opening in the lever 201 allows the retention element engaged in the guide groove 15 to slide behind the lever 201 and then come into contact with the first bearing surface 204 or cam surface when the lever returns to its first retention position P1 and the cam retains the retention element 44A. The retention element 44A is thus trapped in the guide groove 15 and retained vertically by the cam surface or first bearing surface 204. The boot is thus fitted and retained vertically in the fastening device. This rear opening 210 is limited by a first arm 211 connecting an upper part of the lever (which includes the first bearing surface 204 and the second bearing surface 208) to a lower part of the lever (which includes in particular the circular opening 202). The first arm 211 is positioned on the rear side of the lever. A second arm 215, on the front side of the lever, also connects the upper part of the lever to its lower part. These two arms surround the opening 203 and make the lever more rigid. As an alternative, one of these two arms 211, 215 could be dispensed with, for example the arm 211 which is thinner than the arm 215. Thus, the rear opening 210 has a dimension along the transverse axis Y at least equal to the length by which the retention element 44A of the boot projects beyond the guide groove 15 in the direction Y towards the outside of the base.

Figure 12:
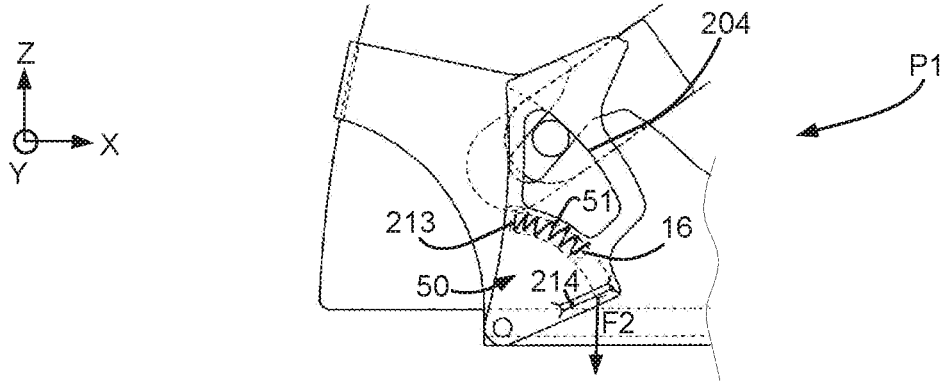
FIG. 12 is a partial transparent side view of the boot and a fastening device according to a second embodiment of the invention, the lever being in the first position, referred to as the retention position.

As shown in FIGS. 12 and 13, the fastening device 3 comprises a return means 50 exerting a force on the lever bearing the cam surface and tending to move this lever from its third position, referred to as the retracted position P3, into its initial position P0, this being a stable position. The return means 50 in particular takes the form of a helical spring 51 but as an alternative it could be replaced by any other equivalent return means. The spring 51 is positioned in a housing 212 in the lever. The housing 212 has the shape substantially of an arc of a circle centred on the circular opening 202. The spring 51 is mounted in compression between an end 213 of the housing and a stop 16 rigidly secured to the base. When the lever is in its third position, referred to as the retracted position P3, the spring 51 is in a state of maximum compression. When the lever is in its initial position P0, the spring 51 is in a state of minimum compression. Thus, when at rest, the lever naturally returns from the third position, referred to as the retracted position P3, into the initial position P0. When the boot is engaged against the fastening device, as soon as the retention element 44A leaves the second bearing surface 208 and moves down into the guide groove 15, i.e. as soon as it ceases to bear on this bearing surface 208, the return means causes the lever to rotate rearwards, thereby causing the retention element to pass through the rear opening 210 before coming to bear against the first bearing surface 204, the lever 201 then taking up the first retention position P1.

At rest, when the boot is not engaged in the fastening, the lever 201 does not pivot rearwards owing to the mating of shapes produced respectively on the lever 201, on the inner face, and on the lateral wall of the base, on the outer face, forming an end stop. When the boot is fitted, the fitting force is sufficient to overcome this end stop.

To allow the boot to be released from the fastening device, the lever further comprises a release pedal or handle 214, for manually pivoting the lever into its third position, referred to as the retracted position P3. This release handle 214 could also be pivoted with the foot. The release handle is in the form of a protrusion rigidly secured to the body of the lever and extending outwards from the fastening device, parallel to the transverse axis Y. It may have a substantially rectangular shape. As shown in FIG. 12, a force F2 oriented downwards on the release handle tends to move the lever into its third position, referred to as the retracted position P3. The release handle 214 may be actuated by the user to release his boot from the fastening device. As an alternative, the user could also press on another part of the lever, for example on the second bearing surface 208 to pivot it forwards, into its third position P3. Thus, when the lever is in the retracted position P3, in the position furthest forward, the guide groove 15 is completely clear and the retention element 44A of the boot may move upwards and come out of the guide groove 15 entirely to allow the boot to be released from the fastening device.

In the embodiments shown, the release handle forms a single piece with the lever bearing the cam surface, but it would not be departing from the scope of the invention if this release handle were formed by an element other than the lever bearing the cam, interacting with this lever to rotate it. Furthermore, the gripping element 216 and the release handle 214 or pedal have been presented as two separate elements. As an alternative, these two elements could form one and the same component, for example taking the form of a handle extending parallel to the transverse axis Y. The user could then pull upwards on this handle so as to pivot the lever in the direction of clamping S, or conversely, could push downwards on this handle so as to pivot the lever in the direction of release D.

Figure 15:
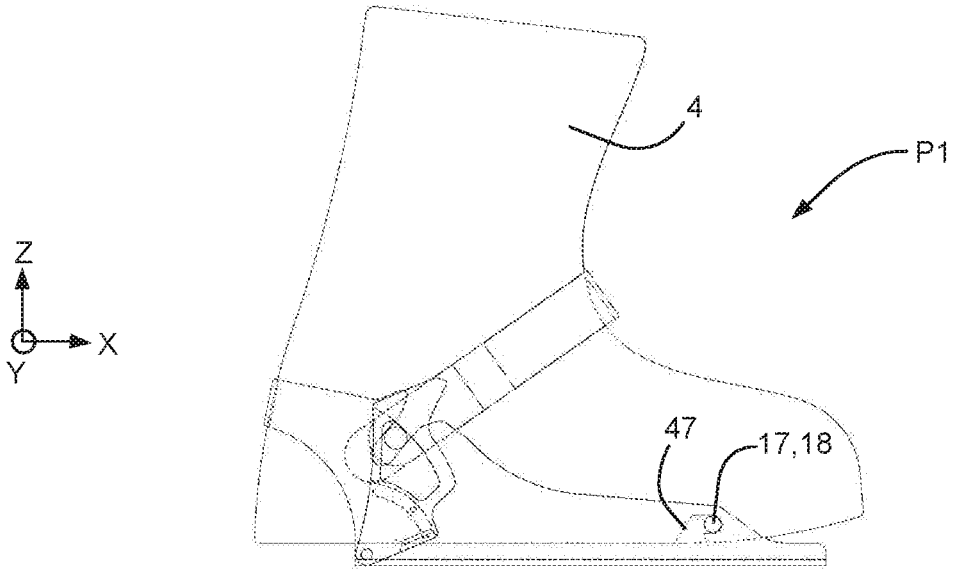
FIG. 15 is a transparent side view of the boot and the fastening device according to the second embodiment, the boot being held in place vertically and the lever being in its first position, referred to as the retention position.
Figure 16:
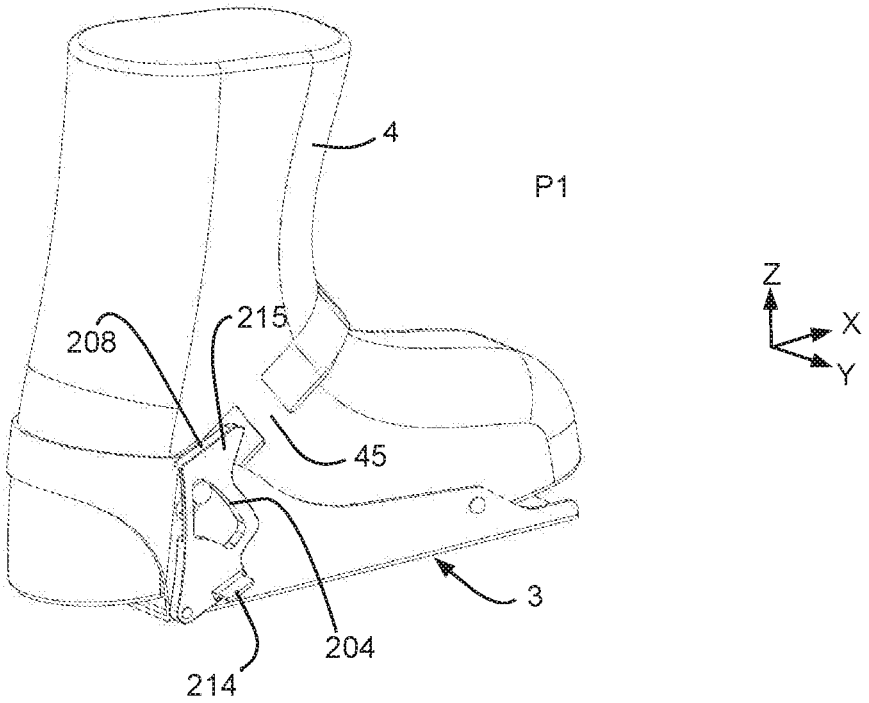
FIG. 16 is a perspective view of the boot and the fastening device according to the second embodiment in the configuration of FIG. 15.
Figure 17:
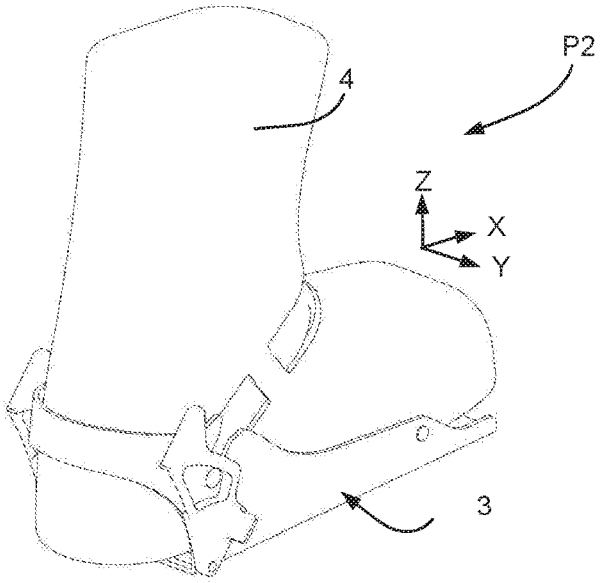
FIG. 17 is a perspective view of the boot and the fastening device according to the second embodiment, the lever being in its second position, referred to as the clamping position.

With reference to FIGS. 10 and 15, the base further comprises a stop means 17 positioned at the front of the base and constituting a means for front attachment of the boot. The stop means 17 may interact with a mating element of the boot. The stop means makes it possible to correctly position the boot when fitting the boot and to retain the front of the boot in the vertical direction of the base, along the axis Z. More specifically, according to the embodiment shown, the stop means 17 is a lug 18 extending transversely towards the inside of the base from a lateral flank of the base. This lug, of generally cylindrical shape, is particularly visible in FIG. 4. The lug may interact with a cut-out 47 made in a lateral edge of the sole of the boot. The cut-out 47 may have a bent profile comprising an engagement portion 47A extending vertically and a retention portion 47B extending longitudinally. When the lug is in place in the retention portion, it requires a very specific movement of the foot to bring it out of the cut-out. To engage the boot in the fastening device, the user may first of all move his foot forwards with the front pointing downwards. He then brings the lug 18 to meet the cut-out 47 until the lug reaches the retention portion 47B. He may then pivot his foot about a transverse axis AT1 passing through the lug 18 in such a way as to bring his heel to the baseplate 11. With such a movement, the retention element 44A located in the rear portion of the boot comes into contact against the second bearing surface 208 substantially always at the same point, to allow the boot to be fitted in the fastening device.

In other embodiments of the invention, the lug 18 and cut-out 47 elements could be reversed, i.e. the lug could be positioned on the lateral sides of the boot, in the front zone thereof, and the cut-out could be positioned in the front lateral walls of the fastening device. Any other attachment means, such as hooks or mating shapes, could be envisaged to attach the front portion of the boot to the fastening device, this attachment allowing at least vertical retention of the front portion of the boot. Incidentally, when the stop means 17 interacts with the lug 18, the movement of the boot relative to the fastening device is guided. In particular, the boot describes a rotational movement in which the axis of rotation corresponds to the axis AT1. Thus, it could be possible to envisage doing away with the guide groove 15 or widening the latter since guidance would be ensured by the interaction of the stop means 17 with the lug 18.

Figure 19:
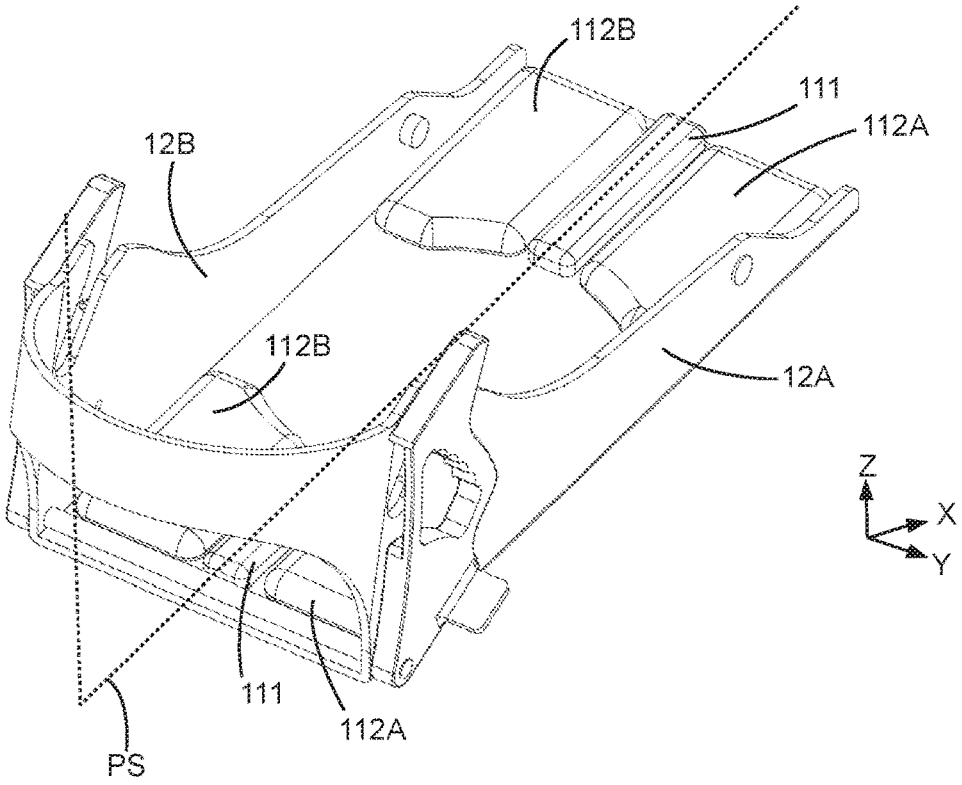
FIG. 19 is a perspective view of a fastening device according to a first alternative embodiment of the invention.

FIG. 19 shows an alternative embodiment of the baseplate 11 of the base 10, which is particularly suitable for the clamping device obtained by the interaction of the strap with the levers as described above. The baseplate 11 comprises a median portion 111 and two lateral portions 112A, 112B extending transversely on either side of the median portion 111. The median portion 111 is more rigid than the two lateral portions 112A, 112B. For example, the two lateral portions 112A, 112B may be made of foam or any other equivalent material, covering the baseplate 11 of the base 10, capable of deforming elastically when pressed on by the sole of the boot and hence by the foot of the user, to ensure comfort and/or act as a shock absorber for the latter. The median portion 111 may be made of plastic. It may form a one-piece assembly with the rest of the base, for example obtained by injection moulding of plastic. When the two lateral portions 112A, 112B are not compressed, they may extend substantially at the same height as the median portion along the vertical axis Z. Advantageously, this height is greater than the height of the hinge pin 14, thus preventing the sole of the boot from coming into contact with this hinge pin and interfering with the rotation of the lever.

As clearly shown in FIG. 19, the median portion and the two lateral portions may be interrupted between the front and the rear, in particular to leave space for an adjustment mechanism (not shown) for adjusting the orientation of the fastening device relative to the sliding board about the vertical axis Z. Outside this central zone, the median portion 11 and the two lateral portions 112A, 112B take up the whole width of the baseplate between the two lateral flanks 12A and 12B.

Thus, the presence of less rigid lateral portions 112A, 112B allows the boot to pivot slightly about a longitudinal axis, with a rolling movement, while remaining generally firmly clamped against the base. To be specific, when the boot is retained and clamped in the fastening device, the strap 42 has a position which is fixed relative to the fastening device, owing to the fact that the lateral retention elements 44A, 44B mounted on the strap 42 are rigidly secured to the fastening device. It is therefore the rest of the boot, excluding the strap, which can move relative to the strap and to the fastening device, in particular can rotate, causing a rolling movement about the axis X. This is possible owing to the ability of the strap 42 to slide relative to the cuff of the boot. The user may thus freely modify or adjust his bearing on the sliding board, while the foot remains firmly clamped. He thus gains even better control over his trajectory. In particular, the user gets the same sensations as with a conventional fastening in which the boot is retained only by two straps fastened to the fastening device and independent of the boot, and in particular the fastening device according to the invention allows the boot to perform a rolling movement relative to the base, as in the conventional fastenings mentioned above.

By virtue of the invention, the user can easily attach his boot to the sliding board in such a way that the sliding board is retained on his foot and cannot come loose. This operation does not require the user to use his hands since all that is required is to engage the lever by bringing his foot to the fitting ramp as described above. Before the boot is fitted, the strap is only secured to the boot. After attaching the boot in the fastening device, the strap becomes secured to the base. Then, a single gesture on the gripping element 216 allows the user to adjust the level of clamping of his foot against the sliding board. Once the lever has been clamped, the strap is secured to the fastening device. Depending on the compromise between comfort of use and precision, the user can pull more or less forcefully on the lever bearing the cam surface, i.e. pivot it to a greater or lesser degree from the first position, referred to as the retention position P1, into the second position, referred to as the clamping position P2. When the first bearing surface has only a few notches, the user can easily find a level of clamping that suits him by identifying the notch on which the retention element of the boot, connected to the strap, must stop. His boot is clamped from above, i.e. the strap exerts a force on the user's instep so as to firmly press the boot on the bottom of the fastening device. The rigidity of the materials from which the body of the boot is made thus has no bearing on the quality of clamping obtained. It is thus possible to obtain an automatic fitting system, as well as a boot which is particularly comfortable, along with precise, efficient clamping of the boot against the sliding board.

When snow accumulates under the sole of the boot or on the fastening device, the user can still fasten his boot to the sliding board without having to clear off the snow. To this end, the user manipulates the lever in such a way as to obtain a given resistance. Lastly, the force produced to manipulate the lever is directly correlated to the force applied by the strap on the instep of the boot. Through use, the user can thus easily find the level of clamping that suits him. Later, if the snow that has got in between the boot and the fastening device should melt or become compacted, thus modifying the level of clamping of the strap, the user can easily adjust the level of clamping of the lever.

Incidentally, in the particular case in which the retention elements 44A, 44B are fastened directly to the cuff, to the sole or to any other element of the boot, clamping of the levers makes it possible to compress the sole to a greater or lesser extent against the sliding board. Greater or lesser compression of the sole makes it possible to adjust the sensations felt by the user in the soles of the feet. Moreover, when the retention elements are fastened to a cuff made of sufficiently flexible material, the cuff can deform under the effect of the force exerted by each of the levers and a degree of clamping of the foot can be obtained. The clamping thus obtained can be modulated by adapting the rigidity of the cuff and the position of the retention elements on the cuff. The advantage of being able to simply fasten the boot to the fastening device without having to remove the snow accumulated between the sole and the fastening device is obtained even when the retention elements are secured to the cuff, the sole or any other element of the boot.

Then, to remove or release the boot from the fastening device, a single gesture is enough since all that is required is to press on the release handle of the lever bearing the cam to make the lever pivot forwards, for example using the release handle 214. Pressing can be performed manually or for example with the other foot, if it is free of its own fastening device. By virtue of the connection between the two levers, right and left, 201 and 301 by means of the connection bar 14, a single action on one of the levers makes it possible to open the two levers simultaneously to allow the boot to be released.

Thus, the lever consists of a single component combining the functions of automatic fitting of the boot, retention of the boot, unclamped, against the sliding board, clamping of the boot against the sliding board, and lastly an interface with the user, since for clamping and release the user manipulates the lever directly, not another element connected to the lever. According to the embodiment of the invention described, the lever is articulated in rotation on the fastening device and comprises a cam surface, a fitting ramp, a gripping zone or gripping element for clamping the boot against the fastening device, in particular clamping the strap connected to the boot against the instep, and a release handle or release pedal for releasing the boot from the fastening device.

The lever shown in the various embodiments is optimized and simple since it combines all the elements mentioned above for performing all the functions mentioned above. However, it would not be departing from the scope of the invention if the main lever were to bear only the cam surface and the fitting ramp and if the gripping zone and/or the gripping handle were elements distinct from this main lever, mounted on the base and interacting with this main lever for the purpose of clamping and/or release, respectively.

Various alternative embodiments of the invention will now be described.

Figure 20:
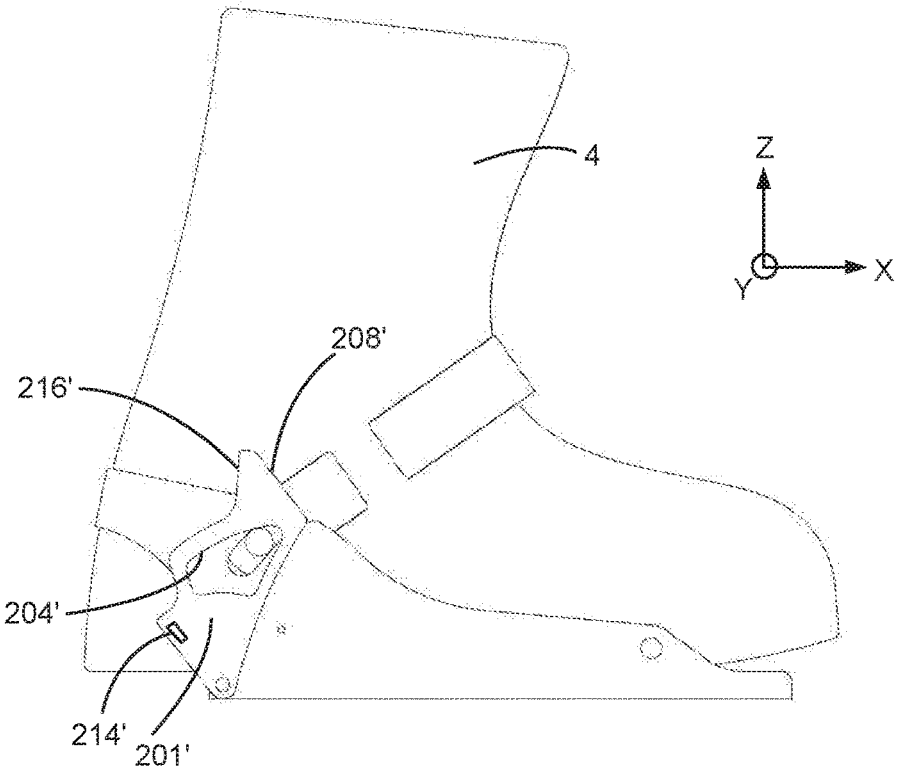
FIG. 20 is a side view of the boot and a fastening device according to a second alternative embodiment of the invention.

As shown in FIG. 20, the lever 201' described above could be reversed. Passage from the first position into the second position would be obtained by pivoting the lever not rearwards but forwards. Likewise, passage from the first position into the third position would be obtained by pivoting the lever not forwards but rearwards. By analogy with the main embodiment described above, the lever would also comprise a first bearing surface 204', a second bearing surface 208', a gripping element 216' for clamping the lever into its clamping position, and a release handle 214' for pivoting the lever into its retracted position. The shape of the first bearing surface 204' or cam surface and of the second bearing surface 208' or fitting ramp is also adapted to take account of this reversed kinematics.

According to another alternative not shown, the fastening device could comprise just a single lever located at the rear of the fastening device. This lever would comprise a lever that can move about a hinge pin oriented longitudinally along the axis X, this lever having a first bearing surface or cam surface, a second bearing surface or fitting ramp and two gripping zones, one for actuating the lever in the direction of clamping and the other for actuating the lever in the direction of release. The boot would then further comprise a strap covering the instep of the boot, the rear ends of which would be connected to one another by a connection, itself having a retention element located in the rear zone of the boot and intended to interact with the lever and in particular with the cam surface of the lever. This retention element, by interacting with the lever, would make it possible to clamp the strap against the instep of the boot towards the base when the lever is moved from its first position, referred to as the retention position, into its second position, referred to as the clamping position, by acting on the gripping element for clamping. According to this alternative, the vertical rear wall 13 of the base would have a substantially vertical guide groove or slot, emerging and opening out upwards, intended to receive and guide the retention element.

Incidentally, when the fastening device has two levers synchronized by a hinge pin, as described above, one of the two levers could be simplified and for example, one of the two levers could in this case not comprise the release handle 214.

The invention thus has the following advantages:

- it proposes a fastening device for fastening a boot with quick and automatic fitting, in which the boot may be fitted without using the hands,
- it proposes a fastening device that may be used even when it is clogged with snow,
- it proposes a boot having possibly a strap that moves by sliding relative to the boot, this sliding allowing the strap to be clamped on the instep of the boot when the boot is already secured to the fastening, thanks to action by the user on a gripping lever of the fastening device which moves the cam and the strap in the direction of clamping, moving the retention element connected to the strap,
- it offers the user the possibility of having a retention position, which is comfortable, in which position his foot is not compressed and the boot is not clamped by the strap, and a separate clamping position in which the foot is securely held in place, i.e. the strap is clamped against the instep and the sliding board can thus be guided effectively.

The invention claimed is:

1. A fastening device for fastening a boot to a sliding board, comprising:

- a base intended to be fastened to a sliding board and to surround, at least partially, a sole and lateral sides of a boot,
- at least one lever that can move relative to the base,
- wherein the lever is able to interact with a retention element connected to a boot, the lever being able to move between a first retention position and a second clamping position, the lever being able to retain the boot in the base when the lever is in the first retention position, the lever being able to transmit a downward force on the retention element when the lever is in the second clamping position, wherein the lever comprises a gripping element adapted to move the lever from the first retention position into the second clamping position in a direction of clamping.

2. The fastening device according to claim 1, wherein the lever is arranged along a lateral side of the base, and wherein the lever is able to interact with a retention element extending laterally from the boot.

3. The fastening device according to claim 1, wherein at least one selected from the group consisting of:

the lever comprises a first bearing surface that is able to vertically retain the lateral retention element, the first bearing surface being in form of a cam, the first bearing surface comprises a first portion adapted to bear against the retention element when the lever is in the first retention position, the first bearing surface comprising a second portion adapted to bear against the retention element when the lever is in the second clamping position, the second portion being separate from the first portion.

4. The fastening device according to claim 3, wherein the lever is able to rotate about a hinge pin, the hinge pin extending parallel to a transverse axis of the fastening device, a first distance separating the first portion from the hinge pin being strictly greater than a second distance separating the second portion from the hinge pin.

5. The fastening device according to claim 3, wherein the lever comprises an opening, an edge of the opening forming the first bearing surface.

6. The fastening device according to claim 4, wherein at least one selected from the group consisting of:

the first bearing surface of the lever is in shape of an arc of a circle, off-centre relative to the hinge pin, the first bearing surface of the lever comprises a row of notches, each of the notches defining a stable clamping position of the lever.

7. The fastening device according to claim 1, wherein the base comprises a lateral side having a guide groove oriented and open forwards and upwards.

8. The fastening device according to claim 7, wherein the lever comprises a release handle, a force oriented downwards on the release handle tending to move the lever into the third retracted position.

9. The fastening device according to claim 1, wherein the lever comprises a second bearing surface forming a fitting ramp, the second bearing surface being adapted to interact with the retention element so as to move the lever from an initial position into a third retracted position.

10. The fastening device according to claim 9, comprising a return means, the return means exerting a force on the lever tending to move the lever from the third retracted position into the initial position.

11. The fastening device according to claim 1, wherein the base comprises a stop positioned at a front of the base, the stop being able to interact with a mating element of the boot.

12. The fastening device according to claim 1, wherein the lever is a first lever that can move relative to the base and the fastening device comprises a second lever that can move relative to the base, the first lever being able to interact with the retention element which is a first retention element connected to a boot, the second lever being able to interact with a second retention element connected to a boot, each of the first lever and second lever being able to move between a respective first retention position and a respective second clamping position, the first lever and the second lever being able to retain the boot in the base when the first lever and the second lever are in the respective first retention positions, the first lever and the second lever being able to transmit a downward force on the first retention element and on the second retention element, respectively, when the first lever and the second lever are in the respective second clamping positions.

13. The fastening device according to claim 12, wherein the first lever is rigidly secured to the second lever, and wherein the first lever and the second lever are adapted to rotate about a same hinge pin, the hinge pin being oriented parallel to a transverse axis of the fastening device, the hinge pin being arranged at the rear of a baseplate of the base.

14. A boot for sport, comprising a strap assembled slidingly, the strap surrounding an instep of the boot, the strap comprising a first free end, extending on a first side of the instep, and a second free end, extending on a second side of the instep, the first free end comprising a first lateral retention element and a second lateral retention element, wherein the first lateral element and the second lateral element are adapted to interact with a first lever and a second lever, respectively, of a fastening device comprising a base adapted to be fastened to a sliding board and to surround, at least partially, a sole and lateral sides of the boot, wherein each of the first lever and the second lever is able to move relative to the base and to interact with the first lateral element and the second lateral element, respectively, each of the first lever and the second lever being able to move between a respective first retention position and a respective second clamping position, the first lever and the second lever being able to retain the boot in the base when the first lever and the second lever are in the first retention position, the first lever and the second lever being able to transmit a downward force on the first retention element and on the second retention element, respectively, when the first lever and the second lever are in the respective second clamping position, so as to clamp the boot against the fastening device.

15. The boot for sport according to claim 14, wherein at least one selected from the group consisting of:

the first retention element extends transversely in a zone of the boot delimited by a rear end of the boot, a lower edge of the boot and a point on the boot intended to be positioned at most at around 20 mm of an inner ankle bone of a user, the second retention element extends transversely in a zone of the boot delimited by a rear end of the boot, a lower edge of the boot and a point on the boot intended to be positioned at most at around 20 mm of an outer ankle bone of a user.

16. A fastening system, comprising:

a fastening device comprising a base, a first lever, and a second lever, and a boot for sport comprising a strap assembled slidingly, the strap surrounding an instep of the boot, the strap comprising a first free end, extending on a first side of the instep, and a second free end, extending on a second side of the instep, the first free end comprising a first lateral retention element and a second lateral retention element, the first lateral element and the second lateral element being adapted to interact with the first lever and the second lever, respectively, of the fastening device, wherein the base of the fastening device is adapted to be fastened to a sliding board and to surround, at least partially, a sole and lateral sides of the boot, wherein each of the first lever and the second lever of the fastening device is able to move relative to the base and to interact with the first lateral element and the second lateral element, respectively, of the boot, each of the first lever and the second lever being able to move between a respective first retention position and a respective second clamping position, the first lever and the second lever being able to retain the boot in the base when the first lever and the second lever are in the first retention position, the first lever and the second lever being able to transmit a downward force on the first retention element and on the second retention element, respectively, when the first lever and the second lever are in the respective second clamping position, so as to clamp the boot against the fastening device.

17. The fastening system according to claim 16, wherein at least one selected from the group consisting of:

the first retention element extends transversely in a zone of the boot delimited by a rear end of the boot, a lower edge of the boot and a point on the boot intended to be positioned at most at around 20 mm of an inner ankle bone of a user, the second retention element extends transversely in a zone of the boot delimited by a rear end of the boot, a lower edge of the boot and a point on the boot intended to be positioned at most at around 20 mm of an outer ankle bone of a user.

18. The fastening system according to claim 16, wherein each of the first lever and the second lever comprises a respective gripping element adapted to move the respective lever from the respective first retention position into the respective second clamping position in a direction of clamping.

19. The fastening system according to claim 16, wherein each of the first lever and the second lever is arranged along a respective lateral side of the base, and wherein each of the first and second lever is able to interact with the respective retention element extending laterally from the boot.

20. A fastening device for fastening a boot to a sliding board, comprising:

a base intended to be fastened to a sliding board and to surround, at least partially, a sole and lateral sides of a boot, at least one lever that can move relative to the base, wherein the lever is able to interact with a retention element connected to a boot, the lever being able to move between a first retention position and a second clamping position, the lever being able to retain the boot in the base when the lever is in the first retention position, the lever being able to transmit a downward force on the retention element when the lever is in the second clamping position, wherein at least one selected from the group consisting of:

the lever comprises a first bearing surface that is able to vertically retain the lateral retention element, the first bearing surface being in form of a cam, the first bearing surface comprises a first portion adapted to bear against the retention element when the lever is in the first retention position, the first bearing surface comprising a second portion adapted to bear against the retention element when the lever is in the second clamping position, the second portion being separate from the first portion.

* * * * *